United States Patent [19]

De Porteous

[11] Patent Number: 5,044,960

[45] Date of Patent: Sep. 3, 1991

[54] MODEL CONSTRUCTION

[76] Inventor: Karl M. De Porteous, 556a Greenhill Rd., Burnside, Australia, 5066

[21] Appl. No.: 423,447

[22] PCT Filed: Jan. 13, 1989

[86] PCT No.: PCT/AU89/00015

§ 371 Date: Sep. 13, 1989

§ 102(e) Date: Sep. 13, 1989

[87] PCT Pub. No.: WO89/06564

PCT Pub. Date: Jul. 27, 1989

[30] Foreign Application Priority Data

Jan. 13, 1988 [AU] Australia ..... PI6282

[51] Int. Cl.[5] ..... G09B 23/28

[52] U.S. Cl. ..... 434/274; 434/267; 446/97; 446/104; 446/121; 446/383

[58] Field of Search ..... 434/86, 262, 267, 274, 434/401; 446/85, 97, 102, 104, 120, 121, 124, 268, 354, 370, 371, 375, 381, 383, 376, 379, 384

[56] References Cited

U.S. PATENT DOCUMENTS

| | | | |
|---|---|---|---|
| 1,359,030 | 11/1920 | Cabana | 446/381 |
| 1,882,575 | 10/1932 | Hanks | 434/274 X |
| 2,129,421 | 9/1938 | Hales . | |
| 2,995,833 | 8/1961 | Bezark | 446/375 X |
| 3,555,723 | 1/1971 | Kopsch et al. . | |
| 3,557,471 | 1/1971 | Payne et al. | 434/274 X |
| 3,716,942 | 2/1973 | Garcia et al. | 446/383 X |
| 4,274,224 | 6/1981 | Pugh et al. | 446/375 |
| 4,854,911 | 8/1989 | Berliner et al. | 446/376 |

FOREIGN PATENT DOCUMENTS

| | | | |
|---|---|---|---|
| 494984 | 5/1977 | Australia . | |
| 520967 | 5/1979 | Australia . | |
| 474250 | 3/1929 | Fed. Rep. of Germany . | |
| 1262851 | 3/1968 | Fed. Rep. of Germany . | |
| 1478344 | 5/1969 | Fed. Rep. of Germany | 446/371 |
| 1007215 | 9/1964 | United Kingdom . | |
| 1038811 | 3/1965 | United Kingdom . | |
| 1286729 | 8/1972 | United Kingdom . | |

*Primary Examiner*—Robert Bahr
*Assistant Examiner*—J. L. Doyle
*Attorney, Agent, or Firm*—Baker, Maxham, Jester & Meador

[57] ABSTRACT

A model skeleton comprises a plurality of interconnected members, hinge joints joining some at least of the adjacent members for relative articulation between those members and a skeletal torso such as to effect partial simulation of animal movements. Each hinge joint has a pair of projections projecting from one member engaging wall of an adjacent member for relative rotation, a barb on the projection retaining that engagement, and sealing surfaces surrounding the projection and effecting seal between those members.

12 Claims, 4 Drawing Sheets

MODEL CONSTRUCTION

This invention relates to a construction for a skeleton of a model, the word "model" in this specification incorporating models of living animals including human beings, for example display models in shops, dolls or the like.

BACKGROUND OF THE INVENTION

Models are frequently formed from polymeric material, sometimes being a foam material having a dense skin, and although not limited to such covering material this invention is applicable thereto. However previously formed models have not been suitably arranged to provide articulation between the joints in a way which will satisfactorily simulate human or animal movement, and in some cases very crude hinge means have existed, for example between the torso and arms or legs of a doll. In the case of a "shop model" used for display purposes for garments, it is extremely desirable that the positions of the limbs can be arranged in the best manner for such purposes, and this involves at least some articulation of the limbs with respect to one another and with respect to the torso in a way in which human or animal attitudes can be simulated.

Another problem which can be encountered in the construction of a model is that the foam plastics material which encases the torso and limbs will tend to flow between the moving parts in such a way that articulation is at least partly inhibited, and another object of the invention is to provide an articulation hinge which will inhibit such flow such that the model skeleton can be encased in moulded polymeric material and still allow articulation of the joints. In an embodiment of the invention, a model skeleton comprises a plurality of interconnected members, hinge joints joining some at least of adjacent said members for relative articulation between those members and a skeletal torso such as to effect partial simulation of animal movements, each said hinge joint comprising a pair of projections projecting from one member engaging walls of an adjacent member for relative rotation, a barb on the projection retaining that engagement, and sealing surfaces surrounding the projection and effecting a friction imparting seal between those members.

In some embodiments the sealing surfaces comprise a resilient flange or skirt of one member which is deflected by the other member upon engagement, and in other instances comprises an O-ring, formed of rubber or other polymeric material which has appropriate snubbing characteristics.

By selecting O-ring size, freedom of relative rotary movement is effectively snubbed, being partly inhibited by the O-ring. Thus it is possible to so arrange the articulating members that they will remain in a position in which they are placed. Similar results can be achieved by suitable interference fits between mating parts.

As said above, one of the problems encountered heretofore has been the tendency for the fluent polymeric material to flow between the articulating surfaces and inhibit articulation, and in another embodiment of this invention there is such an interengagement between the surfaces of the elements of each articulated joint that the space in which an annular flange or skirt, or the O-ring, is contained is protected against influx of fluent foaming polymeric material when the body is moulded over the skeleton of the model. If the elements are formed from a slightly resilient material such as nylon 6, glass-filled polycarbonate or the like, an interference can exist between the hinged elements and the O-ring (if selected) can be housed in an annular space which is protected by that interference against any such influx. Furthermore, the assembly can be quickly and easily effected by a "snap in" movement.

BRIEF DESCRIPTION OF THE DRAWINGS

Embodiments of the invention are described hereunder with reference to and are illustrated in the accompanying drawings, in which.

DETAILED DESCRIPTION OF THE PREFERRED EMBODIMENTS

A consideration of human attitudes will indicate that, if a model is to simulate those attitudes, it is necessary for the upper and lower elements of an arm not only to articulate but also to have relative rotation, and for rotation to be in at least two axes of the upper arm upper portion with respect to the shoulder. The required only hinge joints between the upper arm and shoulder portions are the only joints which are herein illustrated but they are duplicated at other locations in the skeleton of the model, the necessary changes being made.

Figure 1:
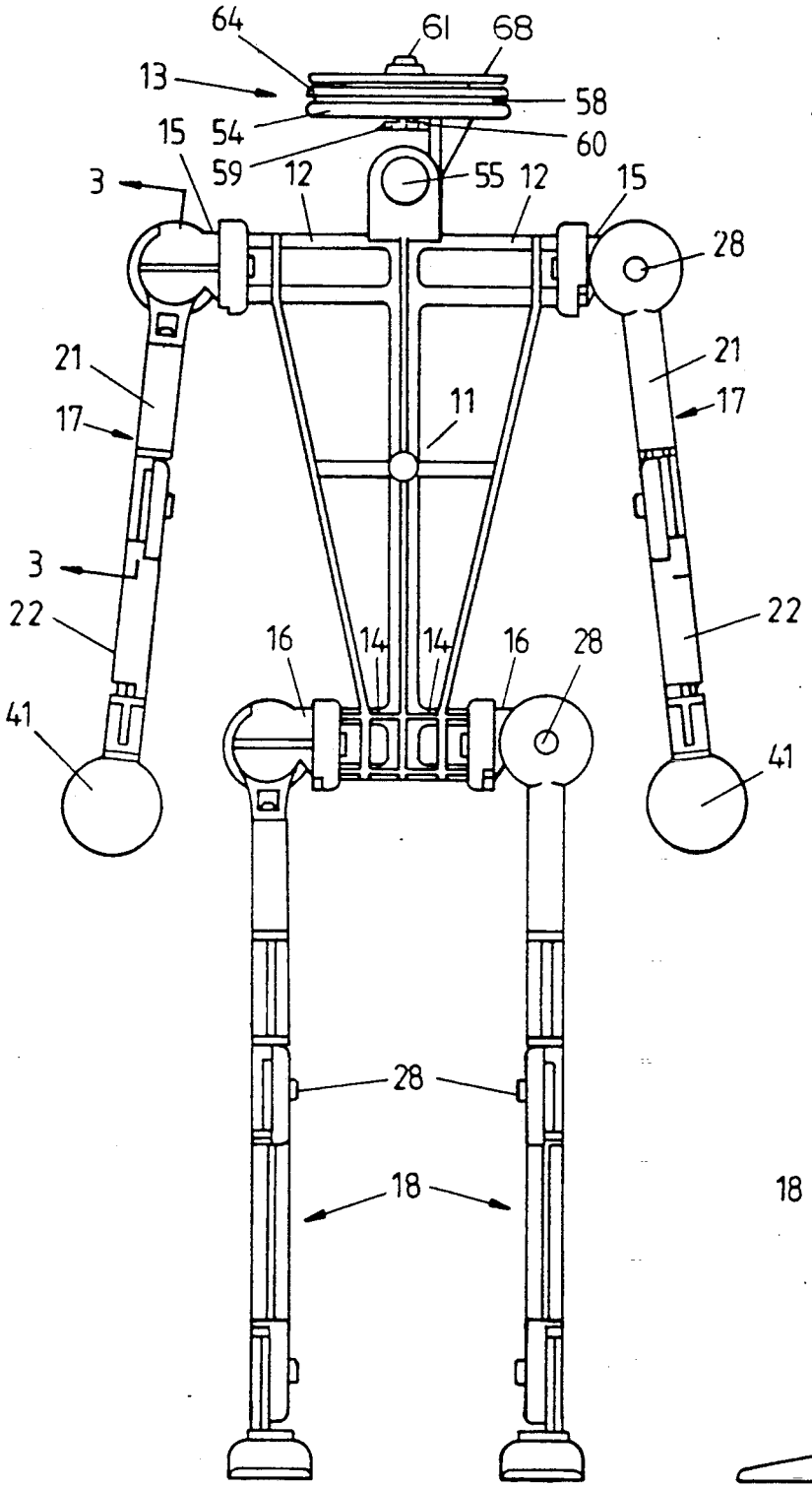
FIG. 1 is a front elevation of a model skeleton, but showing some elements rotated 180° from their normal positions to better illustrate constructional details.
Figure 2:
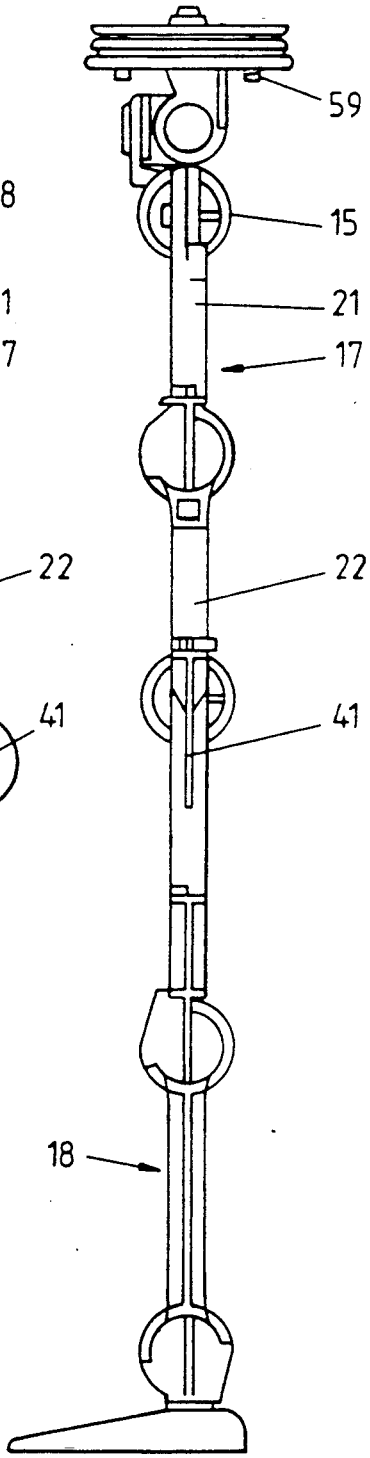
FIG. 2 is a side elevation of FIG. 1.
Figure 5:
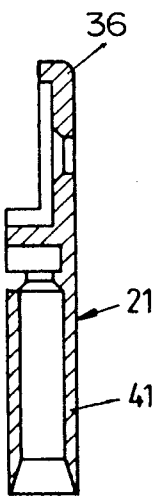
FIG. 5 is an elevational section taken on line 5—5 of FIG. 4.
Figure 6:
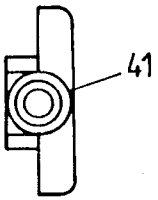
FIG. 6 is an underside view of FIG. 5.

FIGS. 1 and 2 illustrate a complete skeleton as would be located in a mould, before injection of foaming polymeric materials. The skeleton comprises an I-shaped torso 11 having shoulder portions 12, a neck 13 surmounting the shoulder portions 12, and a pair of hip portions 14 at the spine lower end.

A pair of shoulder hinge joint members 15 rotationally join the shoulder portions 12 of the spine to arm assemblies 17, as described below. Similarly, a pair of hip join members 16 rotationally join the hip portions 14 to leg assemblies 18.

Reference is now made to FIGS. 3 to 10 which illustrate an assembly wherein a shoulder hinge joint member 15 is retained to an upper arm upper portion 21 for articulation about an axis which is illustrated to be horizontal. A lower arm portion 22 depends from the upper arm portion 21.

Figure 3:
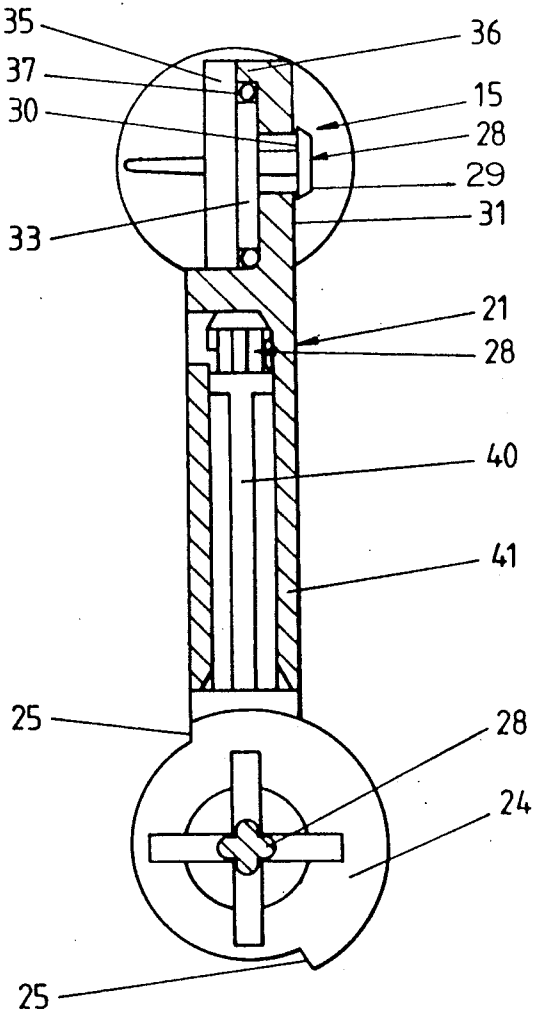
FIG. 3 is a section taken on line 3—3 of FIG. 1, and showing an O-ring type seal.
Figure 8:
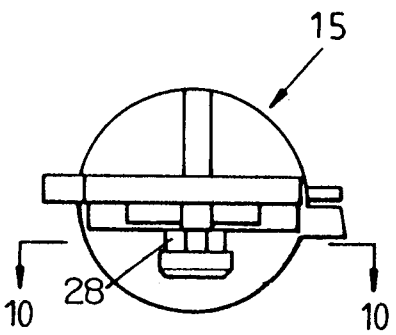
FIG. 8 is an end elevation of FIG. 7.

The shoulder hinge joint member 15 is also similar to the hip hinge joint member 16, the difference being in the circumferential length of a stop portion 24 (FIG. 3).

Figure 4:
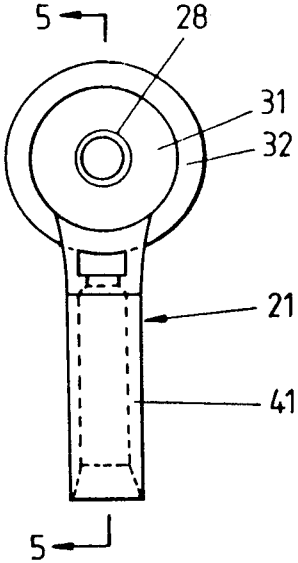
FIG. 4 is an elevation of a limb upper portion.
Figure 11:
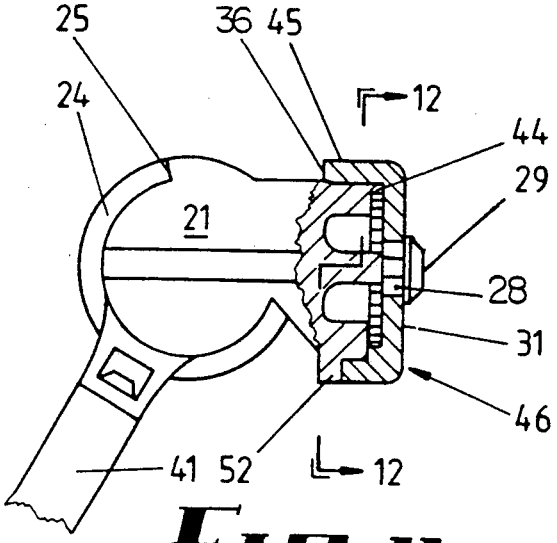
FIG. 11 is a fragmentary section showing an assembly of an arm to shoulder, utilising an interference fit type seal.
Figure 12:
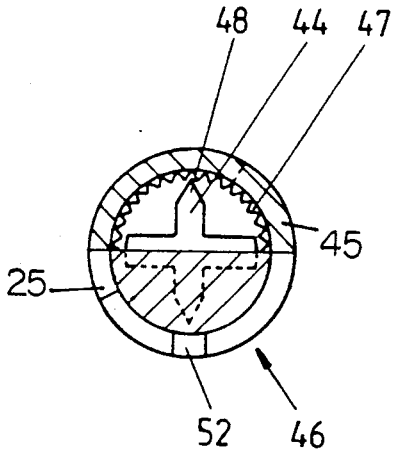
FIG. 12 is a section on line 12—12 of FIG. 11 showing serrated snubbing means.
Figure 13:
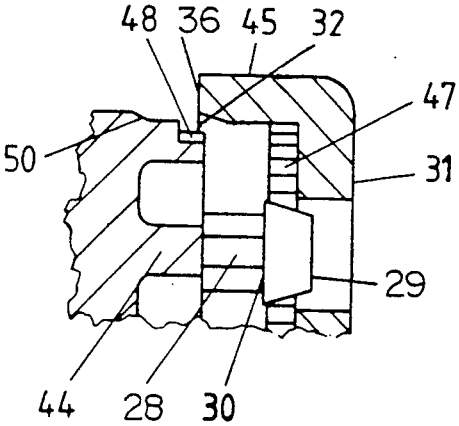
FIG. 13 is a partial sectional view of FIG. 11, but drawn to a larger scale.

The stop portion 24 is provided in each instance with stop faces 25 at the ends thereof which restrict the degree of articulation with the mating element. The shoulder hinge joint member 15 is provided with two barbed projections 28, and similar barbed projections 28 are shown in FIGS. 11, 12 and 13, and used elsewhere in the model. Each barbed projection 28 terminates in an end face 29, and has a spacer portion 40 which is of cruciform section (similar to FIG. 10), and the barb surface 30 is an annular surface of a barb head carried on the end of the resilient spacer stem 40, and firmly engages the outer surface 31 of a shoulder portion of the upper arm upper element 21. The portion of the upper element which is engaged by the barb surface 30 is a flat annular portion of outer surface 31 (FIGS. 3 and 4). A further shoulder 33 surrounds the root end 34 of the barbed projection 28. The abutment in the other direction is between a flange 35 of the shoulder hinge joint member 15 and annular lip 36 of the shoulder portion of the upper arm upper element 21 respectively. These interengaging surfaces seal against influx of moulded material during the moulding portion of the process.

However, in this configuration, the frictional engagement of the resilient materials is insufficient to provide the required degree of snubbing of articulation, and this is achieved by the use of a resilient O-ring 37 which is deformed as the barbed projection 28 is inserted into the receiving aperture of the upper arm upper element 21. O-ring 37 may be of circular or rectangular section material, and is retained concentric with the projection 28 by the shoulder 33. While small tolerances are required to determine the right degree of deformation of the O-ring 37, these can be achieved in a moulding process inexpensively.

It is necessary for there to be some relative rotation between the arm upper and lower arm elements 21 and 22, and this is achieved by the upper element 21 (FIG. 3) having a long resilient stem 40 which is of cruciform cross-section (similar to that shown in FIG. 10) which enters a circular section sleeve 41 and is retained therein by barbed projection 28. The material used is nylon 6, acetyl, or glass-filled polycarbonate, having the facility to be able to flex and thereby restrict the forces which may be imposed upon the skeleton elements and otherwise damage the model. The lower end of the stem 40 terminates in a stop portion 24 which is of similar shape to the above-described shoulder joining member 15, the necessary changes being made (mostly to the shape of the stop portion 24 and consequential position of the stop face 25).

Since the nylon 6, acetyl, or polycarbonate is resilient, it is possible to achieve sufficient snubbing against free rotation of the upper and lower elements 21 and 22 without the use of the resilient O-ring method by causing deformation of the tubular element 21 by stem 40. Ankle, knee and elbow joints are similar to the joints described above.

Although of course dimensions and shapes will change to satisfy the necessary differences, most of the skeletal joints are as described above.

The fingers, toes and neck however do not require the same type of articulation and in those joints use can be made of iron wire over which the polymeric material is moulded.

In order to achieve snubbing between the relatively rotating parts without the use of an O-ring, the arrangement of FIGS. 11, 12 and 13 may be used. In that arrangement (corresponding approximately to the assembly shown in FIG. 3) like members have similar designations, but in lieu of the annular shoulder 33 of FIG. 3 there is provided a cruciform section projection 44 wherein two opposite arms are shorter than the other two opposite arms and the longer arms slightly distort the skirt 45 of a cup-like receiving portion 46. This can either be by bearing against the smooth inner surface of the skirt 45, but preferably is against serrations 47 engaged by pointed ends 48 of one at least of the arms of the projection 44.

In order to achieve a seal against ingress of foaming plastics material, as best seen in FIG. 13, the circular projection 48 comprises a tapered surface 50 which engages the inner surface of the skirt 45 at its mouth with an interference fit.

To inhibit continuous rotation of the upper arm upper element 21, there is provided a projection 52 which abuts the stop face 25 (FIG. 12). Although upon forming of a body part of the skeletal frame some foam polymeric material will necessarily embody the projection 52, that foam material can be removed by initial rotation of the element 21.

Figure 14:
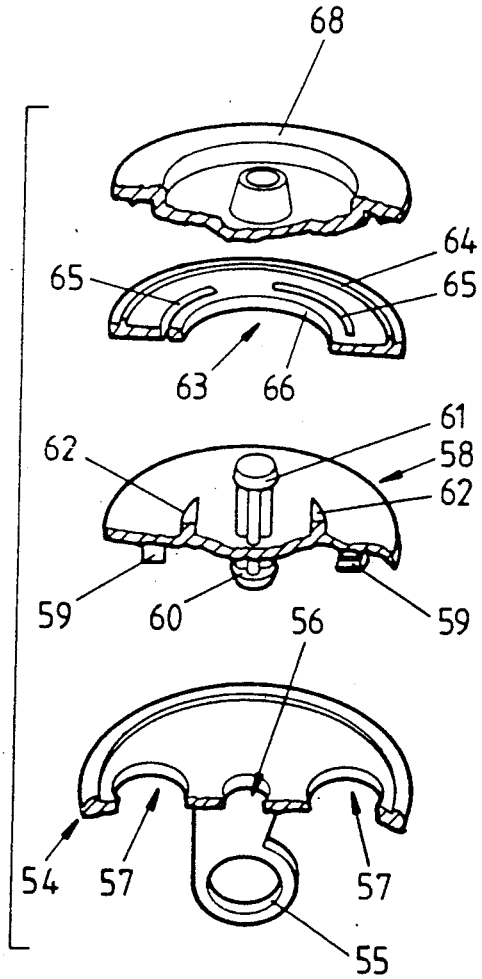
FIG. 14 is an "exploded" perspective view which illustrates the neck elements.

The snub means provided for the neck assembly 13, comprises four discoid portions (FIG. 14), the lower most of which is designated 54 and which is hinged at 55 to the upper end of the torso 11. This contains a central aperture 56 and two radially spaced apertures 57.

The next upper discoid is designated 58 and this will, upon assembly, co-operate with portion 54 to retain the upper-most portion of the body section therebetween. For retaining barbs, discoid portion 58 has a pair of oppositely directed hooks 59 which enter the spaced apertures 57 and engage the undersurfaces of discoid portion 54, being retained thereto both by the barbed spigot 60 which depends from the portion 58 and by foam moulded within the body (and adhesive if required). Portion 58 also has a barbed spigot 61 which extends upwardly, and its upper surface also has two projections 62 which project into the central aperture 63 of the snub plate 64 which is the third discoid portion. The snub plate 64 has three radially spaced but circumferentially extending slots 65 which define flexible ribs 66 with the surface which itself defines central aperture 63, and upon relative rotation of snub plate 64 with respect to discoid portion 58, one rib at least will always be slightly distorted by one of the projections 62. Snub plate 64 is slightly dished in shape to provide a pressure facility against an inturned flange of P.V.C. in the base of a head moulding.

Finally, the upper most discoid portion 68 retains the assembly by engagement of the upstanding barbed spigot 61 of portion 58, and co-operates with snub plate 64 to retain the head of the doll to the neck. Both these elements 64 and 68 have circular ribs which assist in retention of the P.V.C. flange (itself not shown).

Figure 15:
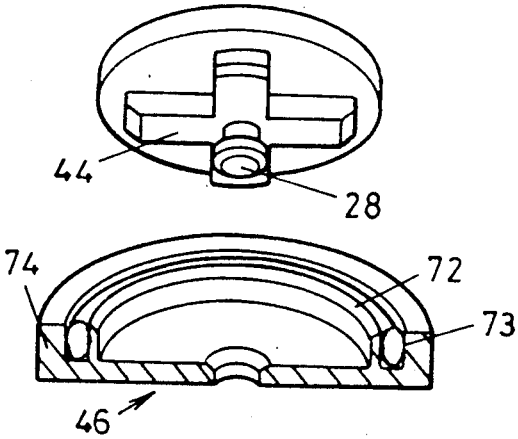
FIG. 15 illustrates an alternative O-ring sealing and snubbing configuration.

FIG. 15 illustrates an arrangement which is an alternative to FIGS. 3, 11, 12 and 13, using an O-ring 73 and a cruciform shaped projection 44 having arms of unequal length to bear against and distort an axially extending rib 72 to provide local radial compression to O-ring 73 against an outer skirt 74 of receiving portion 46. This prevents rubbing sufaces against the O-ring.

and thereby a smooth hinging action is achieved without loss of the snubbing feature.

The desirable radial compression is achieved when the width of the rectangular section annular cavity is less than its depth, as shown in FIG. 15, but when a rectangular section washer-like O-ring is used, the above described cavity shape is not always necessary to achieve such radial compression. The inner curved surface of rib 72 can also be serrated.

Figure 10:
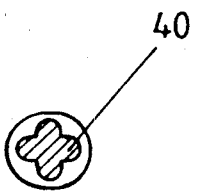
FIG. 10 is a section at line 10—10 of FIG. 8.
Figure 7:
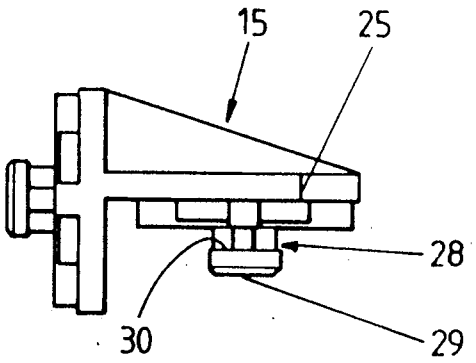
FIG. 7 is a top view of a shoulder or hip joining element.
Figure 9:
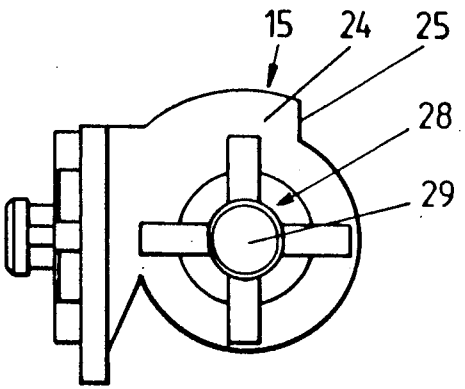
FIG. 9 is a front elevation of FIG. 7.

All the above cruciform sections are described as being similar to stem 40 of FIG. 10, or the cruciform projection 44 of FIG. 12, but clearly such cross-sectional shape can be substituted with a 'Y', or other section comprising radiating ribs.

The torso may also incorporate flexible resilient joints between its ends, and the neck, forearm and palms can also utilise flexible resilient joints. The hinge for the shoulder to the torso can in some instances be of an elongate type wherein plastics material has a reduced thickness strip, so as to resist damage in the event of the torso being moved too far with respect to the shoulder. This hinge method may also apply to neck, forearm and palm.

In all instances wherein the cruciform cross-section of FIG. 10, or a substitute therefor is used, the dimensions are so chosen that excessive force applied against the relevant stop faces 25 can be accommodated by flexure of that portion.

After assembly of a skeleton (which can be extremely fast because of the simple assembly methods) the skeleton is placed within a cavity of a mould and moulded with a suitable polymeric material. One particularly suitable polymeric material is a polyurethane latex "alloy" which is found to provide ideal resilience upon deformation.

The claims defining the invention are as follows:

I claim:

1. Model construction comprising a model skeleton having a torso comprising shoulder and hip portions, arm assemblies, shoulder hinge joints comprising hinge joint members which hingedly join the arm assemblies to the torso shoulder portions, leg assemblies, and hip hinge joints comprising hinge joint members which hingedly join the leg assemblies to the torso hip portions, wherein each said hinge joint member comprises two projections at right angles to each other, one said projection being between a said torso portion and a said hinge joint member, and the other said projection being between said hinge joint member and the relevant said assembly, respective barb heads on the ends of said projections, and annular seal rings surrounding respective said projections, said seal rings engaging with annular abutment surfaces on the hinge joint member and relevant said torso portion, or leg or arm assembly to thereby seal the hinge joint between said projection and said torso portion, hinge joint member or leg or arm assembly, and the seal rings imparting a frictional engagement against said projections of sufficient magnitude to effect a snubbing of hinging movement of the joints.

2. Model construction according to claim 1 wherein each of said leg and arm assemblies comprises an upper portion and a lower portion, and hinge joints joining the upper and lower portions, each of which said hinge joints comprises said hinge joint member.

3. Model construction according to claim 2 wherein said hinge joint interconnecting said upper and lower portions and comprises a resilient stem of a said projection rotationally engaging walls of a sleeve each of said upper and lower portions of a said member.

4. Model construction according to claim 1 wherein each said seal ring is separate from said projection which it surrounds, and said arm and leg assemblies and said torso portion each comprise a shoulder portion having an annular lip surrounding the ring and retaining it concentric with the projection.

5. Model construction according to claim 4 wherein each seal ring is an O-ring.

6. Model construction according to claim 4 wherein said shoulder portion terminates in a flat annular surface which bears against a complementary surface of a said hinge joint member.

7. Model construction according to claim 6 wherein said torso portions are resilient and said barb retains said engagement of those torso portions and resiliently deforms those portions.

8. Model construction according to claim 1 wherein each said barb projection comprises a spacer portion having radiating ribs, and which joins a barb head to a said one member.

9. Model construction according to claim 1 wherein each said projection further comprises a part-circular stop portion having a stop face at least at one end, and each said annular abutment surface comprises a radially outstanding projection which, upon said articulation, can abut a said stop face and limit that articulation.

10. Model construction according to claim 1 wherein each said arm and leg assembly and torso portion comprises a shoulder portion and each said projection comprises a cruciform projection which engages an inner wall surface of a said shoulder portion with an interference fit.

11. Model construction according to claim 1 wherein said skeleton torso is surmounted by a neck comprising four discoid portions, hinge means connecting the lowermost of said discoid portions to the torso, barbed spigot means depending from the next to lowermost discoid portion concentrically engaging said lowermost portion, further barbed spigot means extending upwardly from said next lowermost discoid portion and concentrically engaging the uppermost of said discoid portions, the next to upper most discoid portion being a snubbing disc frictionally engaged by the next to lowermost discoid portion.

12. Model construction according to claim 11 further comprising locking means retaining the lowermost and next to lowermost discoid portions against relative rotation, projections upstanding from the next to lowermost discoid portion, and an aperture in the next to uppermost discoid portion, the aperture surface being frictionally engaged by the upstanding projections.

* * * * *